United States Patent [19]

Lobe

[11] Patent Number: 4,964,826

[45] Date of Patent: Oct. 23, 1990

[54] SAILBOARD FIN RETAINING MEMBER

[76] Inventor: Henry J. Lobe, 100 Archwood Ave., Annapolis, Md. 21401

[21] Appl. No.: 373,460

[22] Filed: Jun. 30, 1989

Related U.S. Application Data

[63] Continuation-in-part of Ser. No. 146,612, Jan. 20, 1988, Pat. No. 4,846,745.

[51] Int. Cl.[5] ..... A63C 15/05

[52] U.S. Cl. ..... 441/79; 114/132

[58] Field of Search ..... 441/74, 79; 114/39.2, 114/127, 132, 140; 403/2

[56] References Cited

U.S. PATENT DOCUMENTS

| | | | |
|---|---|---|---|
| 3,564,632 | 2/1971 | Bahne, Jr. | 9/310 |
| 3,846,030 | 11/1974 | Katt | 403/2 |
| 4,052,826 | 10/1977 | Chisholm | 52/98 |
| 4,398,485 | 8/1983 | Diziere | 114/132 |
| 4,528,924 | 7/1985 | Marker et al. | 114/39 |
| 4,701,144 | 10/1987 | DeWitt, III | 441/79 |
| 4,846,745 | 7/1989 | Lobe | 441/79 |

FOREIGN PATENT DOCUMENTS

| | | |
|---|---|---|
| 3043496 | 6/1982 | Fed. Rep. of Germany . |
| 3129566 | 2/1983 | Fed. Rep. of Germany . |
| 2510968 | 2/1983 | France . |

OTHER PUBLICATIONS

Wind Shear Products, Breakaway Fin Tabs TM .

*Primary Examiner*—Sherman Basinger

*Attorney, Agent, or Firm*—Foley & Lardner, Schwartz, Jeffery, Schwaab, Mack, Blumenthal & Evans

[57] ABSTRACT

An attachment of a fin to an adjustable fin holder of a surfboard or sailboard that protects the fin, fin holder and board structure around the fin holder from damage if the fin strikes an underwater object. The attachment includes a flexible slide member which deforms, permitting release of the flexible member from grooves in a slot in the bottom of the board.

4 Claims, 2 Drawing Sheets

SAILBOARD FIN RETAINING MEMBER

CROSS-REFERENCE

This is a continuation-in-part of application Ser. No. 07/146,612, filed Jan. 20, 1988, and now U.S. Pat. No. 4,846,745, issued July 11, 1989.

BACKGROUND OF THE INVENTION

Sailboarding since its introduction in the 1970s has become an international sport of major proportions and is considered to be the fastest growing water sport in the world. Sailboards are used in conditions ranging from a slight breeze on a calm lake to gale force winds in rough ocean surf.

A sailboard usually consists of a substantially flat, elongated board, a sail system, an optional centerboard system, and a fixed fin mounted aft. Much of the design of the sailboard has been borrowed directly from surfboards, including the fixed fin. A component originally designed for surfing that is used almost universally on sailboards is the adjustable fin holder. The adjustable fin holder allows longitudinal adjustment of the fixed fin's position while the board is out of water, as well as easy installation and removal of the fin.

Because of the versatility and shallow drafts of sailboards, these craft are often sailed in areas where the aft mounted fin will come into contact with an underwater obstruction, such as rock, reef, underwater debris, or the bottom of the sailing area. Damage due to the fin striking an underwater object may result in the following:

1. Breaking of the fin
2. Breaking of the fin holder box
3. Delamination of the fin holder from the board structure
4. Any combination of the above Replacement or repair of the damage described above is in most cases very costly. It is therefore highly desirable to fasten the fin to the fin holder in such a manner as to protect the fin and more expensive fin fastening components from damaging overloads.

PRIOR ART

The adjustable fin holder to which the present invention applies, which is used in most sail and surfboards, differs only in detail from that of U.S. Pat. No. 3,564,632, by W. L. Bahne, Jr., for ADJUSTABLE SURFBOARD FIN HOLDER, which is incorporated by reference herein. This patent explains why an adjustable holder is desirable.

Present practice differs from Bahne in only two respects: The interior sidewalls of Bahne's elongated channel, which converge, and the mating surfaces of Bahne's fin positioning tongue, which form a matching wedge, have both become parallel-sided. As a result, when the fin is drawn into the channel by a bolt, it is clamped against the bottom of the channel, instead of being wedged against the sides. In present practice, the sides of the channel continue to give the fin lateral support.

The clamping means is as shown by Bahne, but today there is only one of them, on the forward end of the fin base. (The rear end is not clamped, but is retained in the channel as described below.) The present invention has to do with this clamping means, especially with Bahne's "retaining plate".

U.S. Pat. No. 4,398,485 by Bernard Diziere for DEVICE FOR DETACHABLY SECURING A CENTERBOARD TO A SAILBOARD OR THE LIKE has the same main object as the present invention, to protect the fin and sailboard from damage when the fin hits something. Diziere is cited as evidence of long-felt need for this type of protection.

Diziere completely replaces the standard Bahne-like adjustable fin holder with an incompatible and non-adjustable fin holder. Unlike Diziere, the present invention has the advantages that it can be readily applied to the very many existing surf and sailboards, and that it retains the advantage of adjustability.

Additional prior art includes German Offenlegungsschrift No. 30 43 496 which includes an arrangement for holding a dagger board in its box in a sailboard. A flexible or elastic cord connects between the dagger board and the box in which it is retained.

Other prior art cited in the parent application and/or its corresponding PCT application include:

U.S. Pat. No. 3,846,030
U.S. Pat. No. 4,052,826
U.S. Pat. No. 4,528,924
U.S. Pat. No. 4,701,144
DE No. 31 29 566
FR No. 2,510,968

SUMMARY OF THE INVENTION

The present invention provides a method of securely mounting a fin to an adjustable fin holder while also providing a means of stress relief to the fin, fin holder, and board structure in the event that the fin experiences physical impact from striking an underwater obstruction. The invention can be used on any sail or surfboard which has the conventional adjustable finholder, described below.

The fin holder used with the invention consists of a rectangular shaped channel which opens flush with the bottom surface of the sailboard. A fin having a longitudinal base member fits into the open channel of the fin holder.

The fit is laterally snug, so that the parallel sides of the fin holder's channel support the parallel sides of the fin base against sideways loads, which are the principal water loads on the fin. In the fore-and-aft direction, the channel is commonly more than twice as long as the base of the fin, allowing the fin to take a range of longitudinal positions.

The fin holder has two longitudinal grooves running its length, between the bottom of the channel and the open top.

("Top" and "bottom" refer here to the board when upside down for storage or to be worked on. When the board is in use, the closed bottom of the channel is above its open top.) The fin is secured against being pulled out of the channel at the front and rear of its base member by use of the longitudinal grooves in the fin holder. The securing means, described below, serve also to resist the relatively small water drag on the fin.

The rear of the longitudinal base member of the fin contains a permanently fixed pin mounted perpendicularly to the plane of the fin and base member. This pin is inserted upon initial installation of the fin to the fin holder into the longitudinal grooves of the fin holder, thus securing the rear section of the fin against being pulled vertically out of the channel.

The longitudinal grooves in the fin holder also house a sliding member into which a bolt passing through the forward end of the base member of the fin is screwed. This secures the forward section of the fin against being pulled out, at the same time resisting longitudinal loads by a clamping action.

The slide member which secures the forward section of the fin to the fin holder is to be made of materials which in one embodiment will suffer catastrophic breakage in the event that these components experience sudden severe loads, as would be the case in the event that the fin of the sailboard strikes an underwater obstruction. In another embodiment the slide member is made of flexible material and is deformed. Upon the breaking or flexing of the slide member, the forward end of the fin base will release from the fin holder while pivoting on the pin at the rear of the fin base, the latter still being held within the longitudinal grooves of the fin holder.

The release mechanism described will greatly reduce the risk of fin breakage, fin holder breakage, and delamination of the fin holder from the board structure. Only a small part will have been broken, or deformed, one for which replacements are easily kept ready and installed. An event which with present equipment could have ended sailing for the day or week is thus reduced to a brief and inexpensive interruption.

BRIEF DESCRIPTION OF THE DRAWINGS

FIG. 6 is and isometric view of a slide member weakened by scoring. FIG. 7 is a cross section through the center of a slide member to which a threaded metal nut is fixed.

DETAILED DESCRIPTION OF THE PREFERRED EMBODIMENTS

Figure 1:
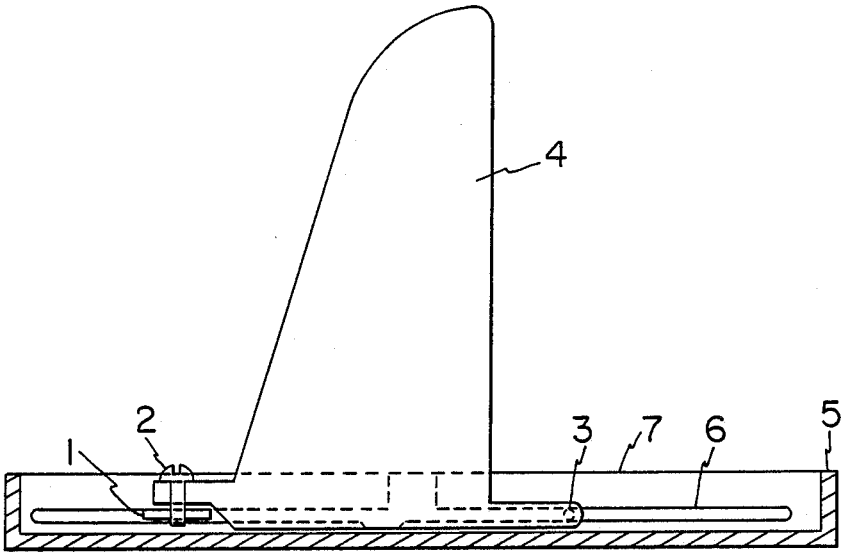
FIG. 1 is a side view of the fin holder with fin inserted and secured. Fin and holder are shown inverted, as they would be upon installation of the fin in a sailboard which is ashore and upside down.

Referring to FIG. 1, a fin 4 shown inserted into a grooved finbox 5 is of typical configuration for a surfboard or sailboard.

Figure 2:
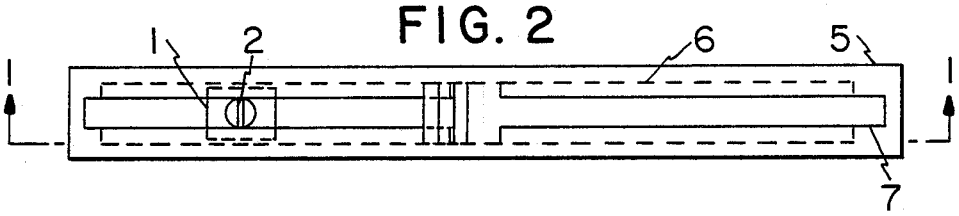
FIG. 2 is a plan view of the fin holder assembly with the breakable threaded slide member installed into the longitudinal grooves of the fin box, looking down at the bottom of the board.
Figure 3:
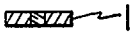
FIGS. 3 and 4 are side and plan views of the breakable slide member used for fastening the fin to the fin holder.
Figure 4:
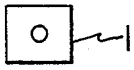
Figure 5:
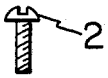
FIG. 5 shows the bolt used for fastening the fin to the slidable member.

The fin holder 5 FIGS. 1,2 has two longitudinal grooves 6 running its length, between the bottom of its channel and an open top 7. The grooves serve to retain flat member 1 (FIGS. 1,2,3,4) so that it can slide forward and aft, but cannot escape from the fin holder except by way of vertical grooves 8.

Grooves 6 also retain a pin 3 (FIG. 1) by its ends, which project from the sides of the after end of the base of fin 4. The ends of pin 3 likewise enter grooves 6 by way of grooves 8 as fin 4 is inserted into fin holder 5. Pin 3 thus secures the after end of fin 4 to fin holder 5, while still allowing fin 4 to slide longitudinally and to rotate about pin 3.

Bolt 2 (FIGS. 1,2,3) when passed through a vertical hole in the forward end of fin 4, screwed into threaded flat member 1 and tightened, pulls flat member 1 up against the upper surfaces of grooves 6 and clamps fin 4 down against the bottom of channel 7, thus holding fin 4 to fin holder 5 rigidly and in whatever longitudinal position is desired.

My invention provides that flat member 1 be the weakest part of the fin holding system, and that it is in one embodiment brittle so that when overloaded by impact of fin 4 with an underwater obstruction it will fail suddenly and completely. Then it can be replaced easily and at small cost in money and time.

Flat member 1 in a second embodiment is made of a flexible material, such as rubber, plastic, thin metal or the like, thus allowing the flat member to become deformed and allowing its release from the longitudinal grooves of the fin holder in the event that the fin 4 is overloaded by impact.

Figure 6:
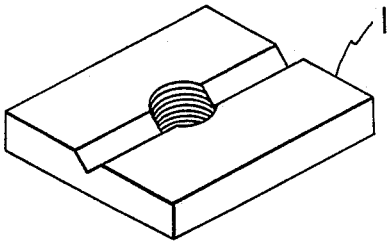
FIGS. 6 and 7 show modified form of the breakable slide member.
Figure 7:
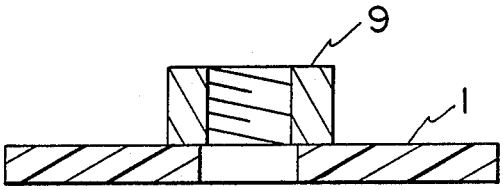
Figure 8:
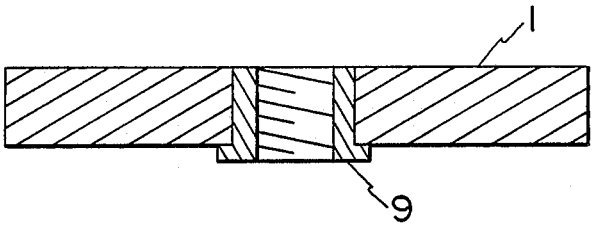
FIG. 8 is a cross sectional view of a preferred embodiment of the slide member.

Besides choosing a different material for slide member 1, or in addition thereto, the construction thereof can be changed. FIGS. 6, 7 and 8 show alternatives to the simple flat plate with tapped central hole.

FIG. 6 shows the original plate scored with a sharp groove in order to weaken it, the score being parallel to the longer side of slide member 1, therefore parallel to longitudinal retaining grooves 6. This design makes it possible to use stronger materials for slide member 1.

In FIGS. 7 and 8 slide member 1 is fitted with a metal nut 9, threaded to receive bolt 2. This construction makes it possible to use for slide member 1 materials which, tapped for bolt 2, would form threads too weak to sustain normal tightening.

Nut 9, shown in cross section, might have almost any shape viewed axially. When being installed, nut 9 cannot be reached with a normal wrench or pair of pliers. Nut 9 must therefore be fastened in or to slide member 1 in order to keep it in place and stop it from rotating when bolt 2 is being tightened. Square or hexagonal shape is therefore not necessary for the usual purpose of gripping the nut with a tool.

There is, however, often an advantage in using a shape which, like a square nut, presents straight, sharp edges to the slide member. Under overloads, when everything is deflecting abnormally, the knife-like edges of such a nut will cut into the slide member, causing it to fail or flex more reliably and consistently than if the nut were round.

Many fastening methods are available, from adhesives to welding. The choice must be appropriate for the materials being used for slide 1 and nut 9, but is wide nevertheless.

The breaking or flexing of flat member 1 allows fin 4 to pivot on pin 3, pin 3 still being retained by grooves 6, thus allowing fin 4 to move in an arc-like manner rearward. The release of the fin from the fin holder as just described will greatly reduce the chance of damage to the fin, fin holder, and delamination of the finholder from the board structure in the event that the fin suffers physical impact from the striking of an underwater obstruction.

It should be noted that my invention is the opposite of present practice, in which flat member 1 is a stainless steel plate and appears to be, judging by the results of repeated accidents, the strongest and most tenacious part of the finholding system. As a rule, either the forward end of the fin breaks at bolt 2, or fin holder 5 is damaged or pulled loose from the board. That is, the most expensive parts fail, not the cheapest.

While specific embodiments of the invention have been described and illustrated, it will be clear that variations in the details of the embodiments specifically illustrated and described may be made without departing from the true spirit and scope of the invention as defined in the appended claims.

What is claimed is:

1. An adjustable fin holder for securing a fin in a slot in the bottom of a sailboard or surfboard comprising:

(a) a flexible means for clamping said fin to said board, a pair of grooves in said slot, said flexible means being retained in said grooves, said flexible means being no stronger than necessary to sustain the ordinary loads to which it is subjected; and (b) all parts of said fin and said board being somewhat stronger than necessary to sustain ordinary loads, so that overloads resulting from an aftward blow to said fin will deform said flexible means, and leave said fin and said board undamaged, and permit the release of said flexible means from the grooves.

2. The fin holder according to claim 1 wherein said flexible means includes a hole therethrough; a bolt extending through said hole; and a threaded means associated with said hole for threadably receiving said bolt.

3. An adjustable fin holder for securing a fin in a slot in the bottom of a sailboard or surfboard comprising:

(a) a brittle means for clamping said fin to said board, a pair of grooves in said slot, said brittle means being retained in said grooves, said brittle means being no stronger than necessary to sustain the ordinary loads to which it is subjected; and (b) all parts of said fin and said board being somewhat stronger than necessary to sustain ordinary loads, so that overloads resulting from an aftward blow to said fin will break said brittle means, and leave said fin and said board undamaged, and permit the release of said brittle means from the grooves.

4. The fin holder according to claim 3 wherein said brittle means includes a hole therethrough; a bolt extending through said hole; and a threaded means associated with said hole for threadably receiving said bolt.

* * * * *